US008893990B2

(12) United States Patent
Seitz et al.

(10) Patent No.: US 8,893,990 B2
(45) Date of Patent: Nov. 25, 2014

(54) ELECTROSTATIC SPRAY SYSTEM

(75) Inventors: David M. Seitz, Riga, MI (US); Daniel J. Hasselschwert, Sylvania, OH (US); Roger T. Cedoz, Curtice, OH (US); James P. Baltz, Waterville, OH (US); Jessica Rose Bryant, Toledo, OH (US)

(73) Assignee: Finishing Brands Holdings Inc., Minneapolis, MN (US)

( * ) Notice: Subject to any disclaimer, the term of this patent is extended or adjusted under 35 U.S.C. 154(b) by 1075 days.

(21) Appl. No.: 12/714,280

(22) Filed: Feb. 26, 2010

(65) Prior Publication Data

US 2011/0210192 A1 Sep. 1, 2011

(51) Int. Cl.

| | |
|---|---|
| ***B05B 5/00*** | (2006.01) |
| ***B65D 83/38*** | (2006.01) |
| ***B05B 5/053*** | (2006.01) |
| ***B65D 83/20*** | (2006.01) |
| *B05B 5/16* | (2006.01) |

(52) U.S. Cl.

CPC ..... *B65D 83/202* (2013.01); *B05B 5/1691* (2013.01); *B65D 83/384* (2013.01); *B05B 5/0531* (2013.01)

USPC ..... 239/690; 239/337; 239/690.1; 239/708; 222/402.13; 222/472

(58) Field of Classification Search

USPC ..... 222/402.13, 470, 471, 472, 474, 496; 239/690, 690.1, 704, 705, 706, 698, 239/700, 3, 337, 708

See application file for complete search history.

(56) References Cited

U.S. PATENT DOCUMENTS

| | | | | |
|---|---|---|---|---|
| 2,890,388 | A * | 6/1959 | Croskey et al. | 361/228 |
| 4,004,733 | A | 1/1977 | Law | |
| 4,248,386 | A | 2/1981 | Morle | |
| 4,275,846 | A * | 6/1981 | Coffee | 239/690 |
| 4,971,257 | A * | 11/1990 | Birge | 239/708 |

(Continued)

FOREIGN PATENT DOCUMENTS

| | | |
|---|---|---|
| CA | 2673037 | 6/2008 |
| JP | 63077562 | 7/1988 |
| WO | 2008074455 | 6/2008 |
| WO | 2008074462 | 6/2008 |

OTHER PUBLICATIONS

Hasselschwert et al., U.S. Appl. No. 12/638,681, filed Dec. 15, 2009.

(Continued)

*Primary Examiner* — Steven J Ganey

(74) *Attorney, Agent, or Firm* — Fletcher Yoder, P.C.

(57) ABSTRACT

A system, in certain embodiments, includes a spray device including a frame having a receptacle configured to receive a self-contained spray can. The spray device further includes a first conductive element configured to contact the self-contained spray can, and a first electrical conductor extending between the first conductive element and an earth ground such that a first electrical potential of the self-contained spray can is substantially equal to a second electrical potential of the earth ground while the self-contained spray can is in contact with the first conductive element. The spray device also includes a corona-charging electrode positioned adjacent to a spray nozzle of the self-contained spray can. The corona-charging electrode is configured to emit a stream of ions toward the self-contained spray can such that a spray of fluid from the spray nozzle passes through the stream of ions and becomes electrostatically charged.

19 Claims, 7 Drawing Sheets

(56) References Cited

U.S. PATENT DOCUMENTS

| | | | | |
|---|---|---|---|---|
| 5,121,884 | A * | 6/1992 | Noakes | 239/691 |
| 5,222,663 | A | 6/1993 | Noakes et al. | |
| 5,400,975 | A * | 3/1995 | Inculet et al. | 239/690.1 |
| 5,427,277 | A * | 6/1995 | Bierend et al. | 222/153.09 |
| 5,531,384 | A | 7/1996 | Greene et al. | |
| 5,582,875 | A | 12/1996 | Ryosuke | |
| 5,630,793 | A | 5/1997 | Rowe | |
| 5,904,273 | A * | 5/1999 | Aspacher et al. | 222/402.15 |
| 5,932,011 | A | 8/1999 | Noakes et al. | |
| 6,079,634 | A | 6/2000 | Noakes et al. | |
| 6,199,766 | B1 | 3/2001 | Fox et al. | |
| 6,216,966 | B1 | 4/2001 | Prendergast et al. | |
| 6,279,834 | B1 | 8/2001 | Fox et al. | |
| 6,311,903 | B1 | 11/2001 | Gaw et al. | |
| 6,318,647 | B1 | 11/2001 | Gaw et al. | |
| 6,326,062 | B1 | 12/2001 | Noakes et al. | |
| 6,343,714 | B1 * | 2/2002 | Tichenor | 222/153.11 |
| 6,349,854 | B1 * | 2/2002 | Bierend et al. | 222/153.11 |
| 6,482,357 | B1 | 11/2002 | Fox et al. | |
| 6,592,813 | B1 | 7/2003 | Fox et al. | |
| 6,612,510 | B1 | 9/2003 | Fox et al. | |
| 6,682,004 | B2 | 1/2004 | Kadlubowski et al. | |
| 6,814,318 | B2 | 11/2004 | Wilson et al. | |
| 7,150,412 | B2 | 12/2006 | Wang et al. | |
| 7,152,817 | B2 | 12/2006 | Wilson et al. | |
| 7,393,385 | B1 | 7/2008 | Coffey et al. | |
| 7,460,924 | B2 | 12/2008 | Alexander et al. | |
| 7,815,132 | B2 | 10/2010 | Baltz | |
| 2007/0194157 | A1 | 8/2007 | Golden et al. | |
| 2008/0202413 | A1 | 8/2008 | Seitz et al. | |
| 2008/0213499 | A1 | 9/2008 | Matsumoto et al. | |
| 2010/0072309 | A1 * | 3/2010 | Hodge et al. | 239/690 |

OTHER PUBLICATIONS

PCT International Search Report and Written Opinion dated May 4, 2011.

U.S. Appl. No. 12/954,525, filed Nov. 24, 2010, Bryant et al.

Patent Application P04-032, filing date: Mar. 31, 2004.

* cited by examiner

ELECTROSTATIC SPRAY SYSTEM

BACKGROUND

The invention relates generally to an electrostatic spray system and, more specifically, to a system for electrostatically transferring a charge to a spray emitted from an aerosol can.

Aerosol spray coating systems may have a low transfer efficiency, e.g., a large portion of the sprayed coating material does not actually coat the target object. For example, when a metal fence is sprayed with an aerosol spray paint can only a small portion of the paint may coat the target fence, thereby wasting a large portion of the paint. Further, aerosol spray systems may also apply uneven coatings to a target object, causing an undesirable finish.

BRIEF DESCRIPTION

A system, in certain embodiments, includes a spray device including a frame having a receptacle configured to receive a self-contained spray can. The spray device also includes a trigger assembly disposed within the frame and configured to selectively engage a spray of fluid from a spray nozzle of the self-contained spray can. The spray device further includes a first conductive element configured to contact the self-contained spray can, and a first electrical conductor extending between the first conductive element and an earth ground such that a first electrical potential of the self-contained spray can is substantially equal to a second electrical potential of the earth ground while the self-contained spray can is in contact with the first conductive element. The spray device also includes a corona-charging electrode positioned adjacent to the spray nozzle of the self-contained spray can. The corona-charging electrode is configured to emit a stream of ions toward the self-contained spray can such that the spray of fluid from the spray nozzle passes through the stream of ions and becomes electrostatically charged.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
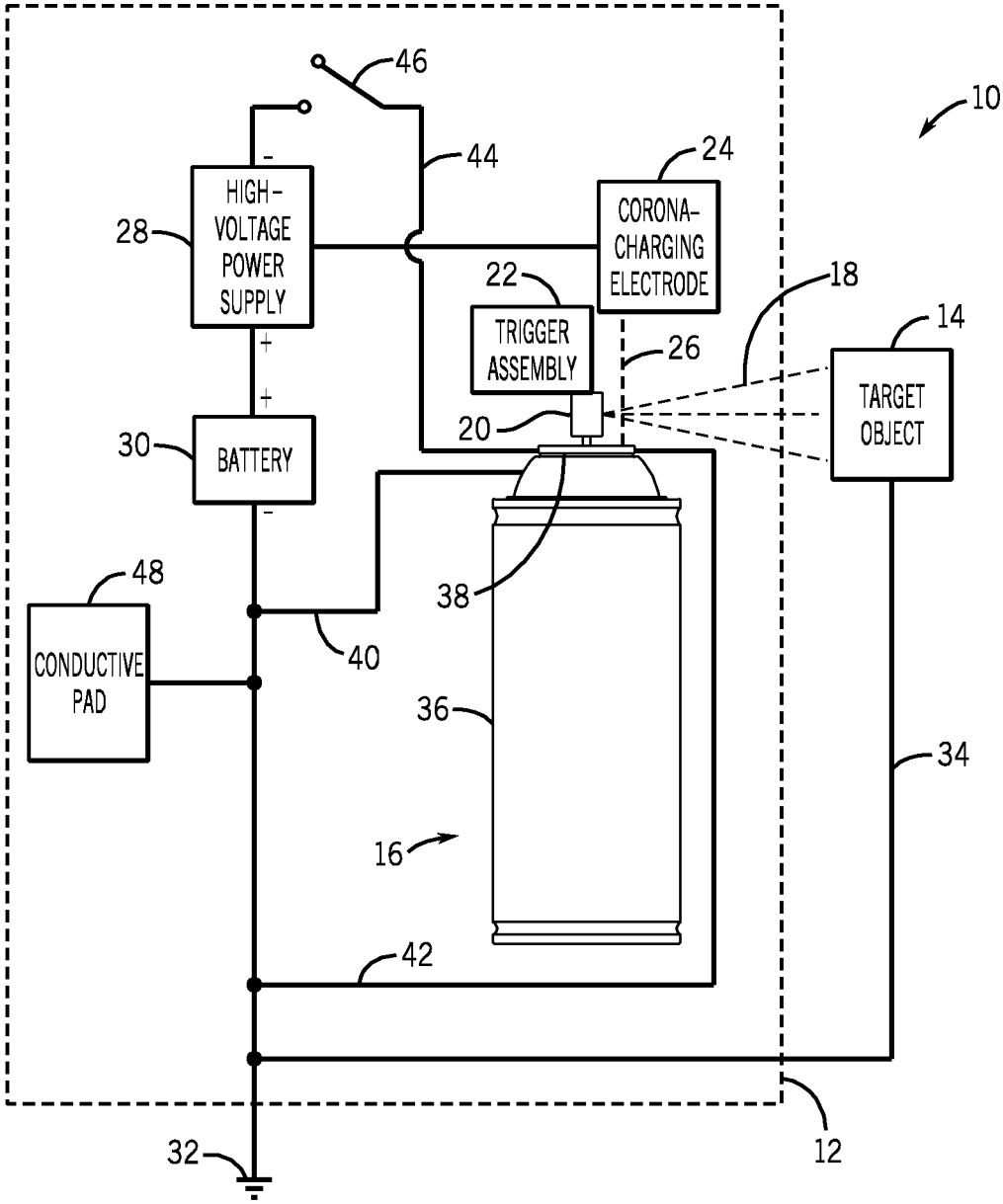
FIG. 1 is a diagram illustrating an exemplary spray coating system in accordance with certain embodiments of the present technique.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

Embodiments of the present disclosure may enhance the transfer efficiency of fluid sprayed from a self-contained spray can by electrostatically charging the spray of fluid. In certain embodiments, the spray device includes a frame having a receptacle configured to receive a self-contained spray can. The spray device also includes a trigger assembly disposed within the frame and configured to selectively engage a spray of fluid from a spray nozzle of the self-contained spray can. The spray device further includes a first conductive element configured to contact the self-contained spray can, and a first electrical conductor extending between the first conductive element and an earth ground such that a first electrical potential of the self-contained spray can is substantially equal to a second electrical potential of the earth ground while the self-contained spray can is in contact with the first conductive element. The spray device also includes a corona-charging electrode positioned adjacent to the spray nozzle of the self-contained spray can. The corona-charging electrode is configured to emit a stream of ions toward the self-contained spray can such that the spray of fluid from the spray nozzle passes through the stream of ions and becomes electrostatically charged. Because the self-contained spray can is electrically coupled to the earth ground, a steep electrical gradient (e.g., large voltage differential over a small distance) may be maintained between the corona-charging electrode and the spray can, thereby increasing an electrostatic charge on the spray of fluid and enhancing the transfer efficiency between the fluid and the target object. In addition, because the spray device employs the corona-charging electrode, the electrode may be positioned outside of a flow path of the fluid spray, thereby substantially reducing or eliminating build-up of fluid on the electrode and ensuring that the fluid is sufficiently charged.

FIG. 1 is a diagram illustrating an exemplary spray coating system 10 including a spray device 12 for applying a desired coating to a target object 14. In the present embodiment, the spray device 12 includes a self-contained spray can 16 configured to provide a spray of fluid 18 toward the target object 14. As will be appreciated, the self-contained spray can 16 may include a liquid, such as paint, and a pressurized gas or propellant. As illustrated, the spray can 16 also includes a spray nozzle 20 having a valve assembly which seals the liquid and propellant within the spray can 16. When the spray nozzle 20 is depressed, the valve opens, thereby facilitating a flow of liquid through the spray nozzle 20. Due to the pressure exerted by the propellant on the liquid, the liquid breaks up into droplets as the liquid exits the spray nozzle 20, thereby forming an aerosol or spray of fluid 18. As droplets impact the target object 14, the target object 14 is coated with the liquid. In certain embodiments, the liquid is a paint which forms a coating on the target object 14 as the paint dries.

The illustrated spray device 12 includes a trigger assembly 22 configured to selectively engage the spray of fluid 18 from the spray nozzle 20 of the self-contained spray can 16. As discussed in detail below, the trigger assembly 22 includes an actuating arm which depresses the spray nozzle 20 when a trigger is engaged, thereby inducing the spray of fluid 18 toward the target object 14. In addition, the spray device 12 includes an indirect charging device, such as the illustrated corona-charging electrode 24, configured to electrostatically charge the spray of fluid 18 from the spray nozzle 20. As will be appreciated, charging the spray of fluid 18 imparts an electrostatic charge on the fluid droplets. Consequently, the droplets will be electrostatically attracted to an electrically grounded object, such as the target object 14, thereby increasing the transfer efficiency between the fluid and the target object 14. In the present embodiment, the corona-charging electrode 24 emits a stream of negatively charged ions 26 which imparts a negative charge on the spray of fluid 18 as it passes through the stream. However, it should be appreciated that alternative embodiments may employ other indirect charging devices (e.g., electromagnetic transducers) to impart an electrostatic charge of the fluid droplets.

Indirect charging devices, such as the corona-charging electrode 24, may not directly contact the spray of fluid 18. Because the indirect charging device may be positioned outside of the flow path of the fluid droplets, the device may remain substantially free of fluid build-up, thereby enabling a substantially continuous charge to be applied to the spray of fluid 18. In contrast, direct electrostatic charging systems may place an electrode in the path of the fluid droplets to electrostatically charge the droplets via contact with the electrode. Because the electrode is in the fluid path, large droplets may form on the surface of the electrode during operation. These droplets may periodically break free and enter the spray of fluid 18. As the large droplets impact the target object 14, an imperfection in the spray coating may be formed. Because indirect charging devices may not contact the spray of fluid 18, the possibility of finish imperfections caused by large droplet formation may be substantially reduced or eliminated.

In addition, direct charging systems may employ a modified spray nozzle to deliver the electrical charge to the spray of fluid. For example, the nozzle of the self-contained spray can may be replaced with a nozzle incorporating an electrode. Because there are many types of spray cans and nozzle, such nozzle replacement may result in added complexity and increased cost associated with spray device operation. In contrast, because the indirect charging device (e.g., corona-charging electrode 24) does not directly contact the spray of fluid 18, standard aerosol spray cans may be employed without modification of the spray nozzle.

As illustrated, the corona-charging electrode 24 is electrically coupled to a high-voltage power supply 28 which supplies a high-voltage signal to the electrode 24. For example, in certain embodiments, the high-voltage power supply 28 may provide more than approximately 5 k, 7.5 k, 9 k, 10.5 k, 15 k, 20 k, 25 k, 30 k, 35 k volts, or more to the corona-charging electrode 24. While a high-voltage signal is provided, a relatively small electrical current may be sufficient to impart the desired charge on the fluid droplets. For example, in certain embodiments, the high-voltage power supply 28 may be configured to output less than approximately 100, 80, 60, 50, 40, 30, or less micro-Amperes. As illustrated, a positive terminal of a battery 30 is electrically coupled to a positive terminal of the high-voltage power supply 28. Based on the desired power output from the high-voltage power supply 28, a commercially available battery (e.g., 9V, 12V, etc.) may be employed to provide electrical power to the high-voltage power supply 28. Alternatively, a standard or proprietary rechargeable battery may be employed in certain embodiments.

In the present embodiment, the negative terminal of the battery 30 is electrically coupled to an earth ground 32. As will be appreciated, the earth ground is not a chassis ground or floating ground, but rather a direct or indirect connection to the earth. Consequently, the potential of the earth ground 32 will be substantially equal to the potential of the earth. For example, a suitable earth ground 32 may be established by driving a conductive stake into soil. In such a configuration, an electrical charge flowing into the stake will be dissipated through the soil. Alternatively, the earth ground 32 may include an electrical connection to a conductive water pipe or main having a subterranean portion. The subterranean portion of the conductive pipe serves to dissipate an electrical charge into the soil in a similar manner to the stake described above. The earth ground 32 may also include an electrical connection to a building ground (e.g., the ground plug of an electrical outlet).

As illustrated, an electrical conductor 34 extends between the target object 14 and the earth ground 32. Consequently, the potential of the target object 14 will be substantially equal to the potential of the earth ground 32. As a result, the potential difference or voltage between the electrostatically charged fluid droplets and the target object 14 may be greater than configurations in which the target object 14 is connected to a chassis ground of the spray device 12. For example, if the potential of the chassis of the spray device 12 is greater than the potential of the earth, the potential difference between the charged fluid droplets and the target object 14 will be reduced. Because the present embodiment electrically couples the target object 14 to the earth ground 32, the transfer efficiency of the fluid spray 18 may be enhanced due to the increased potential difference.

In addition, the self-contained spray can 16 is electrically coupled to the earth ground 32. As illustrated, the spray can 16 includes a body 36 and a neck 38. As will be appreciated, the body 36 and neck 38 may be composed of a conductive material, such as aluminum or steel. However, certain spray cans 16 include a seal between the body 36 and neck 38 composed of an electrically insulative material (e.g., plastic). Consequently, the neck 38 may be electrically insulated from the body 36. Therefore, to ensure that the entire self-contained spray can 16 is grounded, the body 36 and neck 38 may be independently electrically coupled to the earth ground 32. In the present embodiment, an electrical conductor 40 extends between the body 36 of the spray can 16 and the earth ground 32, and an electrical conductor 42 extends between the neck 38 and the earth ground 32. As a result of this configuration, each portion of the spray can 16 is electrically grounded to the earth ground 32.

Electrically coupling the neck 38 of the self-contained spray can 16 to the earth ground 32 may establish a greater potential difference or voltage between the corona-charging electrode 24 and the neck 38 compared to embodiments in which the neck 38 is coupled to a chassis ground of the spray device 12. As previously discussed, if the potential of the chassis of the spray device 12 is greater than the potential of the earth, the potential difference between the corona-charging electrode 24 and the neck 38 of the spray can 16 will be reduced. In addition, the chassis of the spray device 12 may not be able to fully dissipate the charge induced by the stream of ions from the corona-charging electrode 24. As a result, the potential difference between the electrode 24 and the neck 38 may decrease over time, thereby further reducing the potential difference or voltage applied to the spray of fluid 18. In contrast, because the present embodiment electrically couples the neck 38 to the earth ground 32, a steep electrical gradient (e.g., large voltage differential over a small distance) may be maintained between the corona-charging electrode 24 and the spray can 16, thereby increasing the electrical charge on the fluid droplets and enhancing the transfer efficiency with the target object 14.

As previously discussed, the body 36 of the self-contained spray can 16 is also grounded to the earth ground 32. During operation of the spray device 12, the electrostatically charged fluid droplets may contact the body 36 of the spray can 16. Because the body 36 is grounded, a charge induced by the fluid droplets will be transferred to the earth ground 32, and dissipated. As a result, the potential of the spray can 16 may remain substantially equal to the potential of the earth ground 32, thereby substantially reducing or eliminating the possibility of establishing a voltage between the body 36 of the spray can 16 and an object at the ground potential.

As illustrated, a second electrical conductor 44 is coupled to the neck 38 of the spray can 16. The electrical conductor 44 extends between the neck 38 and a negative terminal of the high-voltage power supply 28. As will be appreciated, the high-voltage power supply 28 will not activate until both a positive and negative electrical connection is established with the battery 30. In the present embodiment, the negative electrical connection with the battery 30 includes the electrical conductor 44, the neck 38 of the self-contained spray can 16 and the electrical conductor 42. As a result, the negative electrical connection between the high-voltage power supply 28 and the battery 30 will be interrupted if the spray can 16 is removed from the spray device 12. Consequently, the high-voltage power supply 28 will not activate unless the spray can 16 is present within the spray device 12 and the electrical conductors 42 and 44 are in contact with the neck 38 of the spray can 16. This configuration substantially reduces or eliminates the possibility of accidental contact with a live circuit during insertion or removal of the self-contained spray can 16.

In the present embodiment, the electrical conductor 44 includes a switch 46 configured to selectively activate the corona-charging electrode 24. Similar to the can presence assembly described above, the switch 46 will block current flow to the high-voltage power supply 28 while in the illustrated open position, and facilitate current flow to the high-voltage power supply 28 while in the closed position. It should be appreciated that in alternative embodiments the switch 46 may be positioned between the positive terminal of the battery 30 and the positive terminal of the high-voltage power supply 28. In the present embodiment, the switch 46 is positioned adjacent to the trigger assembly 22 such that depression of the trigger closes the switch 46. In this manner, the spray of fluid 18 is initiated at substantially the same time as activation of the corona-charging electrode 24.

The spray device 12 also includes a conductive pad 48 coupled to the earth ground 32. As discussed in detail below, the conductive pad 48 may be attached to a handle of the spray device 12 such that an operator hand makes contact with the pad 48 while grasping the spray device 12. Because the conductive pad 48 is electrically connected to the earth ground 32, the potential of the operator will be substantially equal to the earth potential while the operator is grasping the spray device 12. Such a configuration substantially reduces or eliminates the possibility of a potential difference being established between the operator and a component of the spray device 12.

Figure 2:
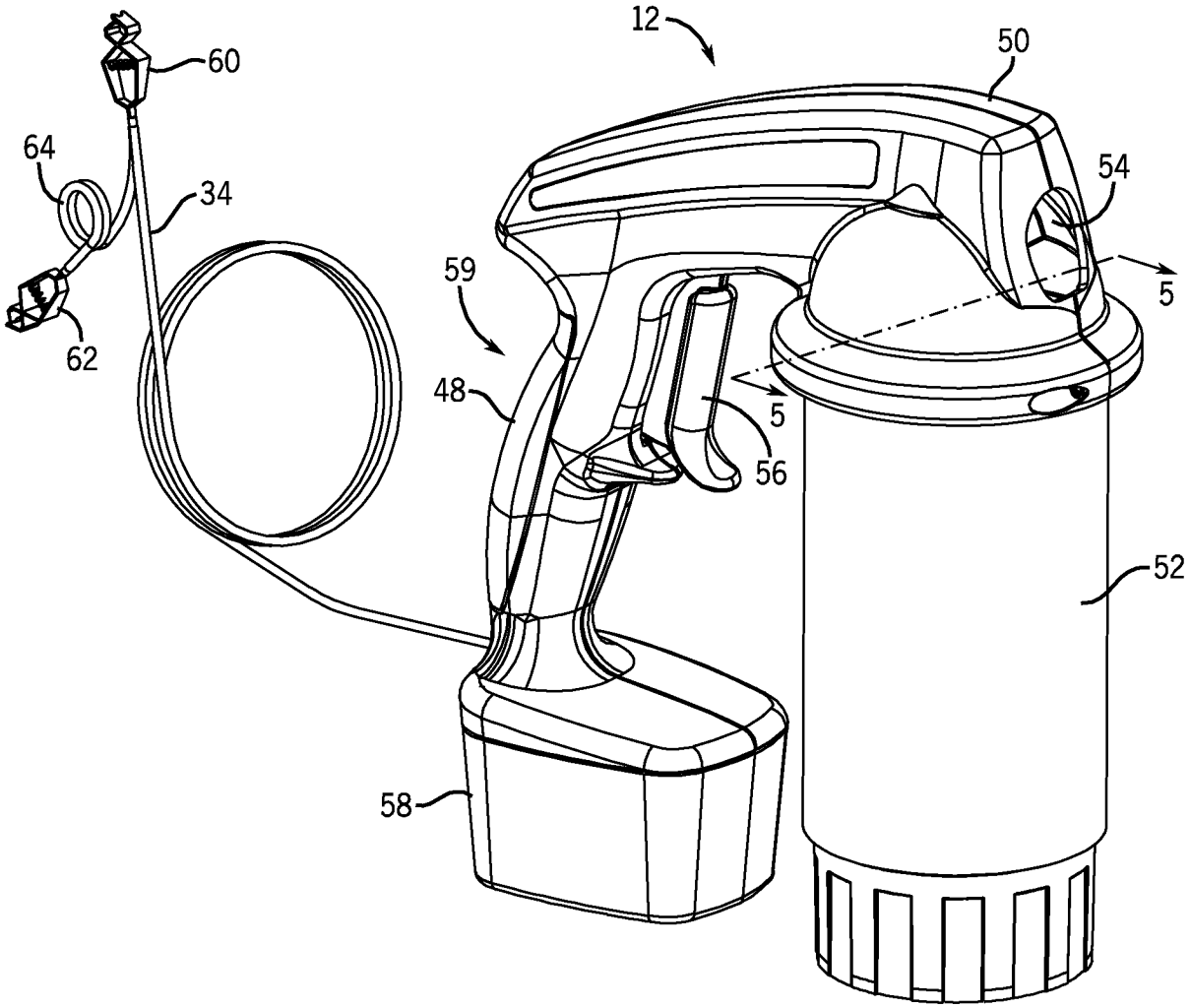
FIG. 2 is a perspective view of an exemplary spray device that may be utilized within the spray coating system of FIG. 1 in accordance with certain embodiments of the present technique.

FIG. 2 is a perspective view of an exemplary spray device that may be utilized within the spray coating system 10 of FIG. 1. As illustrated, the spray device 12 includes a frame 50 and a removable spray can housing 52. As discussed in detail below, the spray can housing 52 is configured to contain and properly position the self-contained spray can 16 within the spray device 12. To couple the spray can 16 to the spray device 12, the spray can housing 52 may be uncoupled from the frame 50, the spray can 16 may be inserted into the housing 52, and the housing 52 may be coupled to the frame 50. Once the spray can 16 is coupled to the spray device 12, the fluid spray 18 expelled from the nozzle 20 may be directed through the opening 54 within the frame 50. For example, an operator may depress the trigger 56, thereby inducing the trigger assembly 22 to activate the nozzle 20 of the self-contained spray can 16. As previously discussed, the trigger assembly 22 may be coupled to the electrostatic activation switch 46 such that depressing the trigger 56 activates the corona-charging electrode 24. In this manner, depressing the trigger 56 induces the spray of electrostatically charged fluid 18 to be expelled from the opening 54 toward the target object 14.

The spray device 18 also includes a power module 58 coupled to a handle portion 59 of the frame 50. In certain embodiments, the power module 58 contains the battery 30 and the high-voltage power supply 28. The power module 58 may be removable such that the battery 30 may be replaced. The handle portion 59 also includes the conductive pad 48 configured to contact an operator hand during operation of the spray device 12. Because the conductive pad 48 is located in the handle portion 59, the operator will contact the pad 48 while grasping the handle 59. Consequently, the operator will be electrically coupled to the earth ground 32, thereby substantially reducing or eliminating the possibility of establishing a potential difference between the operator and a portion of the spray device 12.

As previously discussed, the target object 14 may be coupled to the earth ground 32 by an electrical conductor 34. In the illustrated embodiment, the electrical conductor 34 extends from the spray device 12 to a first spring clip 60, and from the first spring clip 60 to a second spring clip 62 via an electrical conductor 64. The first spring clip 60 may be coupled to the target object 14 and the second spring clip 62 may be coupled to the earth ground 32. As previously discussed, the earth ground 32 may include an electrical connection to a building ground, to a water pipe and/or to a conductive stake disposed within soil. Coupling between the earth ground 32 and the target object 14 via the conductor 64 may ensure that the potential of the target object 14 is substantially equal to the earth potential. In addition, the conductor 34 may be electrically coupled to the conductive pad 48, the neck 38 of the spray can 16, the body 36 of the spray can 16 and the negative terminal of the battery 30 via electrical conductors disposed within the spray device 12.

Figure 3:
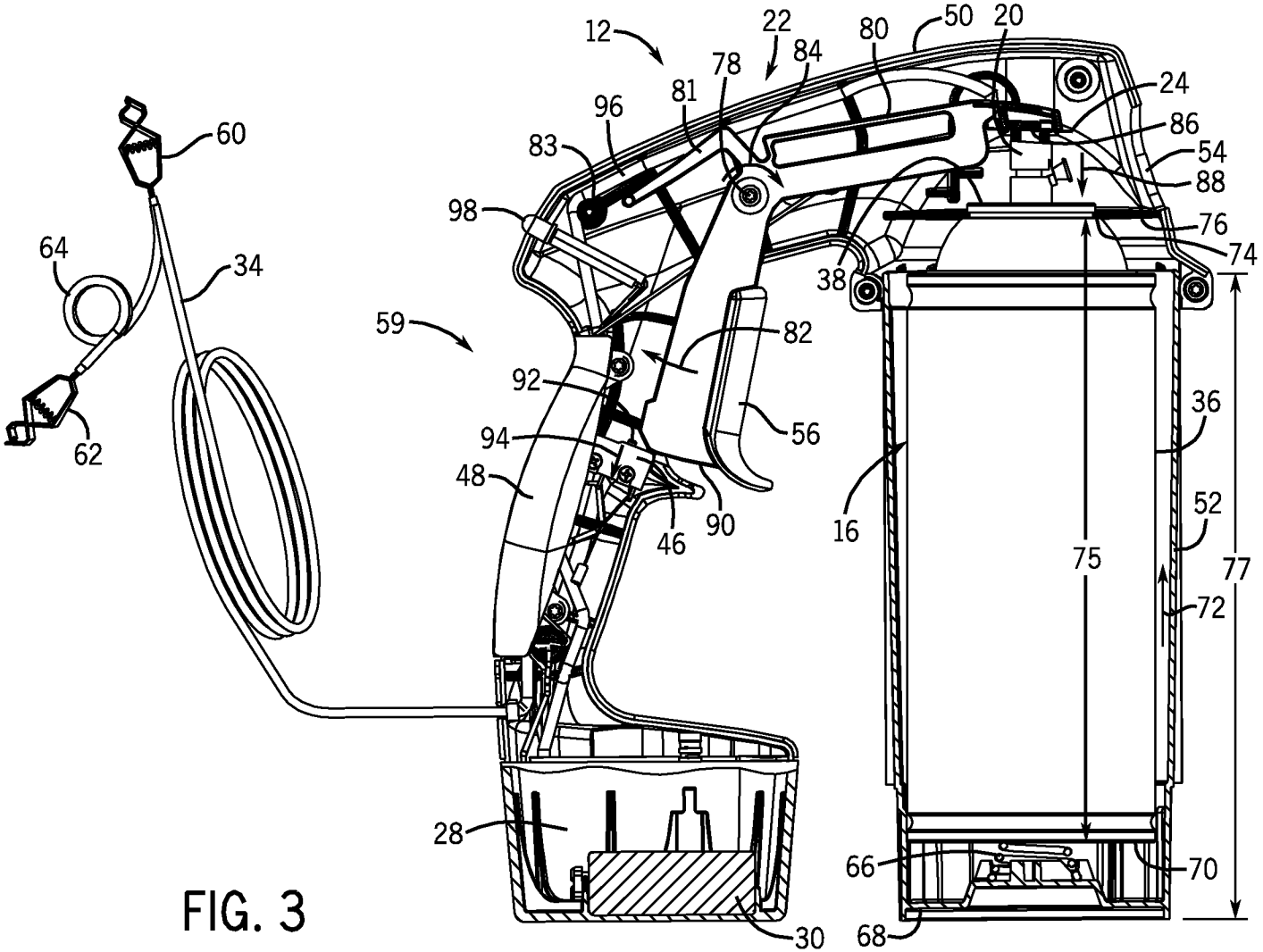
FIG. 3 is a side view of the spray device, as shown in FIG. 2, with a side panel removed to expose a trigger assembly in accordance with certain embodiments of the present technique.

FIG. 3 is a side view of the spray device 12, as shown in FIG. 2, with a side panel removed to expose the trigger assembly 22. FIG. 3 also includes a cross-sectional view of the spray can housing 52, exposing the self-contained spray can 16. As illustrated, a spring 66 extends between a bottom surface 68 of the spray can housing 52 and a bottom surface 70 of the spray can 16. The spring 66 biases the spray can 16 in an upward direction 72 such that a top portion 74 of the spray can 16 contacts a retaining ring 76 of the spray device frame 50. With the top portion 74 of the spray can 16 in contact with the retaining ring 76, the spray nozzle 20 may be located in a proper position for actuation by the trigger assembly 22. The force of the spring 66 in the upward direction 72 serves to maintain the spray can 16 in the illustrated position during operation of the spray device 12.

As will be appreciated, a length 75 between the top surface 74 and the bottom surface 70 may vary between spray cans 16. For example, different manufacturers may produce spray cans 16 having different lengths 75. Consequently, a length 77 of the spray can housing 52 may be particularly selected to accommodate a variety of spray can lengths 75. In addition, the spring 66 may expand or contract based on the length 75 of the spray can 16, while providing the upward bias to maintain contact between the upper surface 74 of the spray can 16 and the retaining ring 76. In this manner, the spray nozzle 20 may be appropriately positioned for spray device operation despite variations in the length 75 of the spray cans 16.

As previously discussed, the trigger assembly 22 may actuate the spray nozzle 20 of the self-contained spray can 16 to initiate the spray of fluid 18 from the nozzle 20. In the present embodiment, the trigger assembly 22 includes the trigger 56, a pivot 78 and an actuating arm 80. As illustrated, the pivot 78 is pivotally coupled to the frame 50 such that the trigger assembly 22 may rotate about the pivot 78. The trigger assembly 22 also includes a biasing member 81 in contact with a protrusion 83 of the frame 50. To initiate the spray of fluid 18, the trigger 56 may be depressed in a direction 82, thereby driving the trigger assembly 22 to rotate about the pivot 78 in a direction 84. As the trigger assembly 22 rotates, contact between the biasing member 81 and the protrusion 83 induces the biasing member 81 to flex, thereby providing resistance to rotation. In addition, rotation of the trigger assembly 22 induces a contact surface 86 of the distal end of the actuating arm 80 to translate in the direction 88. Because the contact surface 86 is positioned adjacent to the spray nozzle 20, movement of the contact surface 86 in the direction 88 drives the spray nozzle 20 toward the neck 38 of the spray can 16, thereby initiating the spray of fluid 18.

In the present configuration, the trigger assembly 22 is configured to activate the corona-charging electrode 24 at substantially the same time as the spray of fluid 18 is initiated. Specifically, the trigger 56 includes a bottom portion 90 positioned adjacent to the electrostatic activation switch 46. As the trigger 56 is depressed in the direction 82, the bottom portion 90 of the trigger 56 contacts a spring-loaded protrusion 92, and drives the protrusion 92 in the direction 94, thereby closing the switch. As previously discussed, closing the switch 46 establishes an electrical connection between the battery 30 and the high-voltage power supply 28, thereby activating the corona-charging electrode 24. Consequently, depressing the trigger 56 will produce a spray of electrostatically charged fluid droplets from the opening 54 in the frame 50 of the spray device 12. As will be appreciated, alternative embodiments may include a switch 46 positioned adjacent to other regions (e.g., actuating arm 80, pivot 78, etc.) of the trigger assembly 22 such that depressing the trigger 56 drives the switch 46 to the closed position. In further embodiments, the switch 46 may be operated independently of the trigger 56 such that an operator may initiate the spray of fluid 18 without activating the electrostatic charging system.

As illustrated, a conduit 96 extends between the high-voltage power supply 28 and the corona-charging electrode 24. The conduit 96 is disposed about the electrical conductor which powers the electrode 24. As will be appreciated, electrical conductors carrying a high-voltage signal may interfere with surrounding electronic devices and/or induce a charge within adjacent conductors or circuits. Consequently, the conduit 96 is configured to shield surrounding devices, conductors and/or circuits from the high-voltage signal passing through the corona-charging electrode supply conductor. The present embodiment also includes an indictor, such as the illustrated light emitting diode (LED) 98, which visually depicts the operational state of the electrostatic charging system. As discussed in detail below, the LED 98 is electrically coupled to the battery 30, and configured to illuminate upon activation of the corona-charging electrode 24. Consequently, an operator may readily determine whether the spray of fluid 18 is being electrostatically charged by the spray device 12.

Figure 4:
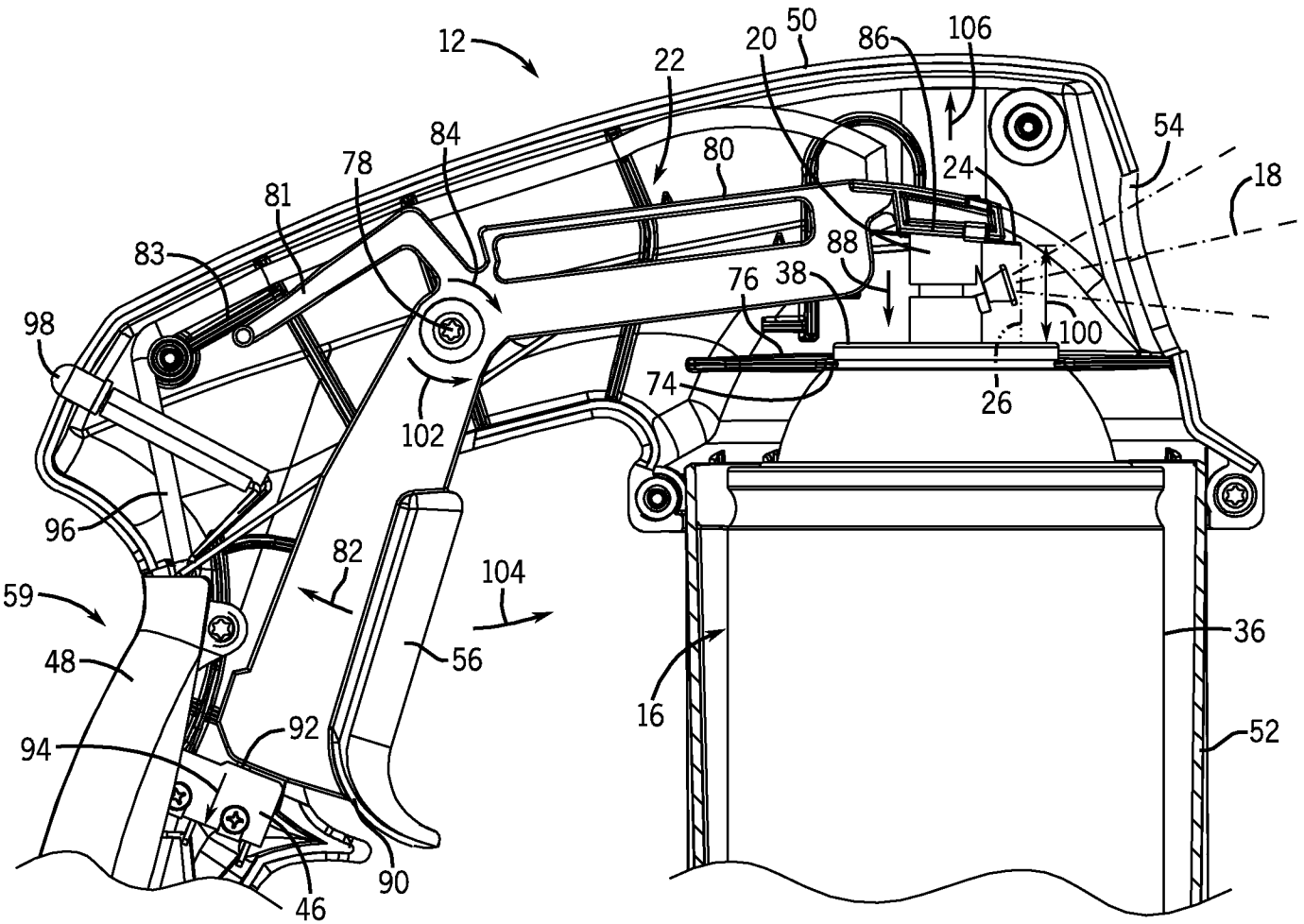
FIG. 4 is a side view of the spray device, as shown in FIG. 3, in which the trigger assembly is rotated to initiate a spray of fluid from a self-contained spray can in accordance with certain embodiments of the present technique.

FIG. 4 is a side view of the spray device 12, as shown in FIG. 3, in which the trigger assembly 22 is rotated to initiate the spray of fluid 18 from the self-contained spray can 16. As illustrated, translation of the trigger 56 in the direction 82 has induced the trigger assembly 22 to rotate about the pivot 78 in the direction 84, thereby inducing the biasing member 81 to flex. In addition, contact between the contact surface 86 of the actuating arm 80 and the spray nozzle 20 has driven the nozzle 20 in the direction 88 from the position illustrated in FIG. 3, thereby initiating the spray of fluid 18. As previously discussed, the size and shape of the opening 54 is particularly configured to accommodate the spray of fluid 18 such that substantially all fluid droplets pass through the opening 54.

Furthermore, translation of the trigger 56 in the direction 82 has driven the protrusion 92 of the switch 46 in the direction 94, thereby closing the switch 46 and activating the corona-charging electrode 24. As illustrated, the corona-charging electrode 24 is positioned a distance 100 from the neck 38 of the spray can 16. In the present embodiment, the distance 100 is approximately 0.5 inches. However, it should be appreciated that alternative embodiments may position the electrode 24 closer or farther from the neck 38. For example, the distance 100 may be greater or less than approximately 0.1, 0.2, 0.3, 0.4, 0.5, 0.6, 0.7, 0.8, 0.9, 1.0 inches in further embodiments. As previously discussed, the neck 38 of the spray can 16 is electrically coupled to the earth ground 32. Therefore, when the corona-charging electrode 24 is activated, a large potential difference or voltage (e.g., 10.5 kV) will be established between the electrode 24 and the neck 38, thereby generating the stream of negatively charged ions 26. As the spray of fluid 18 passes through the ion stream 26, the fluid droplets become electrostatically charged. Due to the large potential difference between the electrode 24 and the neck 38 (e.g., 10.5 kV) and the short separation distance 100 (e.g., 0.5 inches), a steep potential gradient may be established. As will be appreciated, the steep potential gradient may serve to impart an electrical charge on the fluid droplets more efficiently than embodiments which employ a larger separation distance and/or do not ground the neck 38 of the spray can 16 to the earth ground 32. As a result of the increased electrical charge, the transfer efficiency of the fluid spray 18 may be enhanced, thereby increasing fluid coverage of the target object 14.

In the present embodiment, the corona-charging electrode 24 includes a sharp point configured to concentrate a flow of electrons to induce the formation of the ion stream 26. As will be appreciated, the size and/or shape of the point may be particularly configured to establish desired properties of the ion stream 26. While the present corona-charging electrode 24 is composed of brass, it should be appreciated that other suitable materials may be employed in alternative embodiments. In addition, because the corona-charging electrode 24 is not in the flow path of the fluid droplets, the electrode 24 may remain substantially free of fluid build-up, thereby enabling a substantially continuous charge to be applied to the spray of fluid 18. While the ion stream 26 is illustrated as a broken line in FIG. 4, it should be appreciated that the stream of ions 26 may not be visible and/or may produce no visible phenomenon in an actual implementation.

As previously discussed, the spray device 12 includes the conductive pad 48 located in the handle portion 59 and configured to contact an operator hand during operation of the spray device 12. For example, as an operator grasps the handle 59 and depresses the trigger 56, the operator palm may contact the pad 48. Because the conductive pad 48 is electrically connected to the earth ground 32, the potential of the operator will be substantially equal to the earth potential while the operator is grasping the spray device 12. Such a configuration substantially reduces or eliminates the possibility of a potential difference being established between the operator and a component of the spray device 12.

To terminate the spray of fluid 18 and deactivate the corona-charging electrode 24, the operator may release the trigger 56. Contact between the biasing member 81 and the protrusion 83 will then urge the trigger assembly 22 to rotate in the direction 102, thereby driving the trigger 56 in the direction 104 and the actuating arm 80 in the direction 106. As the actuating arm 80 translates in the direction 106, the contact surface 86 will be removed from the spray nozzle 20, thereby disengaging the spray of fluid 18. In addition, translation of the trigger 56 in the direction 104 will remove contact between the bottom portion 90 of the trigger 56 and the protrusion 92. As a result, the switch 46 will transition to the open position, thereby deactivating the electrostatic charging system.

Figure 5:
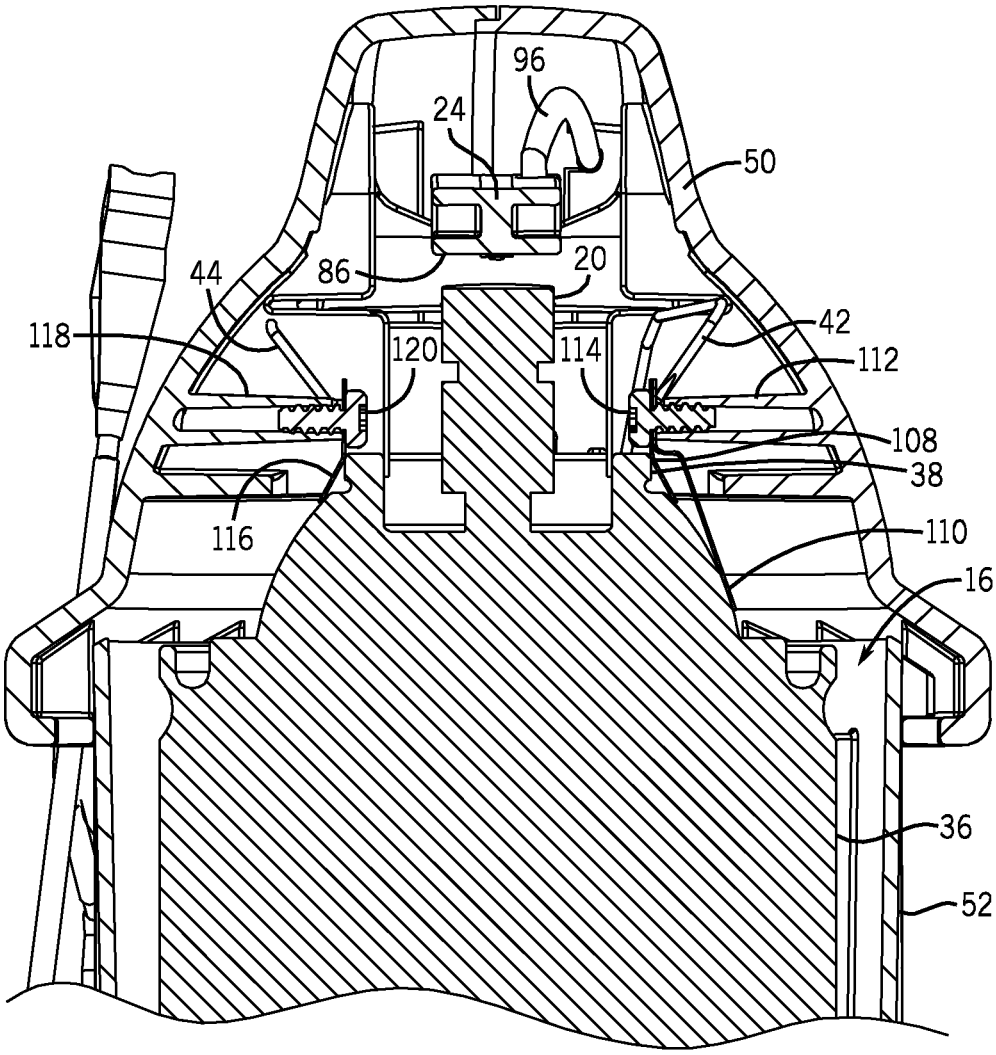
FIG. 5 is a cross-sectional view of the spray device, taken along line 5-5 of FIG. 2, illustrating the electrical contact between the spray device and the self-contained spray can in accordance with certain embodiments of the present technique.

FIG. 5 is a cross-sectional view of the spray device 12, taken along line 5-5 of FIG. 2, illustrating the electrical contact between the spray device 12 and the self-contained spray can 16. As previously discussed, both the neck 38 and the body 36 of the self-contained spray can 16 are electrically coupled to the earth ground 32. Specifically, the electrical conductor 40 extends between the body 36 of the spray can 16 and the earth ground 32, and the electrical conductor 42 extends between the neck 38 and the earth ground 32. As illustrated, a first conductive element, such as the illustrated tab 108, contacts the neck 38 of the spray can 16, and a second conductive element, such as the illustrated tab 110, contacts the body 36. In the present embodiment, the conductive tabs 108 and 110 are flexible and biased toward the spray can 16. Consequently, as the self-contained spray can 16 is inserted into the frame 50 of the spray device 12, the first tab 108 contacts the neck 38 and the second tab 110 contacts the body 36, thereby providing an electrical connection between the spray can 16 and the conductors 40 and 42.

In the present embodiment, the first conductive tab 108 and the second conductive tab 110 are secured to a post 112 within the frame 50 by a fastener 114. As a result, the first tab 108 is in electrical contact with the second tab 110. Therefore, a single conductor 42 may electrically couple both tabs 108 and 110 to the earth ground 32. Such a configuration may be less expensive to produce than an embodiment employing a separate conductor for each tab 108 and 110.

As previously discussed, electrically coupling the neck 38 of the self-contained spray can 16 to the earth ground 32 may establish a greater potential difference or voltage between the corona-charging electrode 24 and the neck 38 compared to embodiments in which the neck 38 is coupled to a chassis ground of the spray device 12. Consequently, a higher electrical charge may be applied to the fluid droplets, thereby enhancing the transfer efficiency with the target object 14. In addition, because the body 36 is grounded, a charge induced by the fluid droplets contacting the body 36 will be transferred to the earth ground 32, and dissipated. As a result, the potential of the spray can 16 may remain substantially equal to the potential of the earth ground 32, thereby substantially reducing or eliminating the possibility of establishing a voltage between the body 36 of the spray can 16 and an object at the ground potential.

As previously discussed, the high-voltage power supply 28 will not activate unless the spray can 16 is present within the spray device 12 and the electrical conductors 42 and 44 are in contact with the neck 38 of the spray can 16. This configuration substantially reduces or eliminates the possibility of accidental contact with a live circuit during insertion or removal of the self-contained spray can 16. To facilitate contact between the conductor 44 and the neck 38, the spray device 12 includes a third conductive element, such as the illustrated conductive tab 116, positioned on an opposite side of the self-contained spray can 16 from the tabs 108 and 110. Similar to the tabs 108 and 110, the third conductive tab 116 is flexible and biased toward the spray can 16. Consequently, as the self-contained spray can 16 is inserted into the frame 50 of the spray device 12, the third tab 116 contacts the neck 38, thereby providing an electrical connection between the spray can 16 and the electrical conductor 44. In the present embodiment, the third conductive tab 116 is secured to a post 118 within the frame 50 by a fastener 120. In this configuration, the neck 38 of the spray can 16 will contact the tabs 108 and 116 when the spray can 16 is properly inserted into the frame 50, thereby establishing an electrical connection between the conductors 42 and 44, and facilitating operation of the electrostatic charging system.

Figure 6:
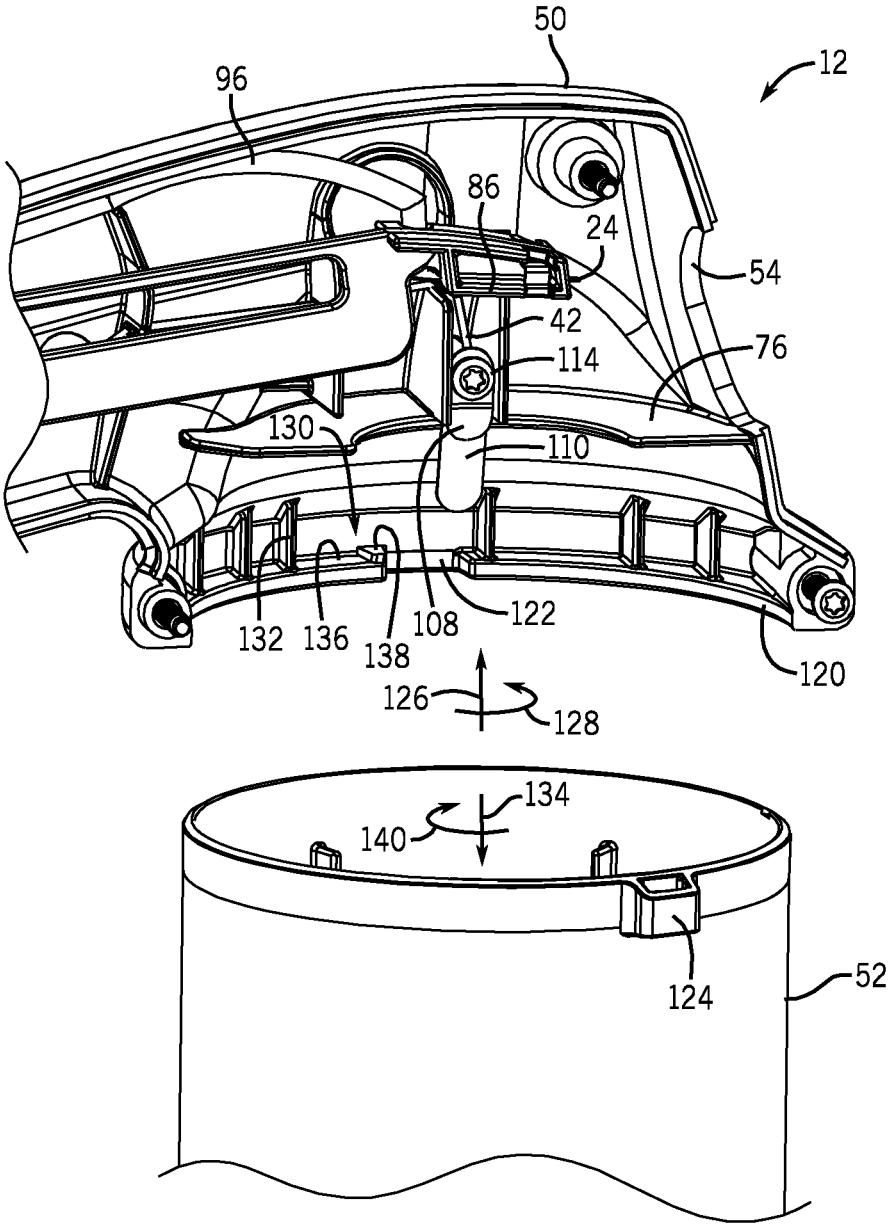
FIG. 6 is a perspective view of the spray device, as shown in FIG. 3, with the spray can housing detached from the spray device body in accordance with certain embodiments of the present technique.

FIG. 6 is a perspective view of the spray device 12, as shown in FIG. 3, with the spray can housing 52 detached from the spray device frame 50. As illustrated, the frame 50 includes a receptacle 120 configured to receive the self-contained spray can 16 and the spray can housing 52. In the present embodiment, the receptacle 120 includes an opening 122 configured to receive a protrusion 124 of the housing 52. In this configuration, the housing 52 may be inserted into the receptacle 120 by aligning the protrusion 124 with the opening 122 and translating the housing 52 in an upward direction 126. While one opening 122 is shown, the present embodiment includes a second opening on an opposite side of the receptacle. In addition, the spray can housing 52 includes a second protrusion 124 on the opposite side of the housing 52. While two protrusions 124 and openings 122 are employed in the present embodiment, it should be appreciated that alternative embodiments may include more or fewer protrusions 124 and openings 122. For example, certain embodiments may include 1, 2, 3, 4, 5, 6, 7, 8, or more protrusions 124 and openings 122. As will be appreciated, in such configurations, the protrusions 124 and openings 122 will be radially aligned to facilitate insertion of the housing 52 into the receptacle 120.

With the spray can 16 disposed within the housing 52, the top surface 74 of the spray can 16 will contact the retaining ring 76 before the protrusion 124 passes through the opening 122. As a result, the spray can 16 will compress the spring 66 during the housing insertion process, thereby inducing a resistance to motion in the upward direction 126. Consequently an operator will apply a force in the upward direction 126 to overcome the spring bias. Once the housing 52 has been inserted, the housing 52 may be rotated in a circumferential direction 128 to secure the housing 52 to the frame 50. In the present embodiment, the frame 50 includes a cavity 130 configured to receive the protrusion 124. Rotation of the housing 52 in the direction 128 moves the protrusion 124 through the cavity 130 until the protrusion 124 contacts a stop 132. Next, the operator may release the upward force such that the spring 66 drives the housing 52 in a downward direction 134 until the protrusion contacts a lower rim 136 of the receptacle 120. As will be appreciated, the lower rim 136 blocks downward movement of the housing 52.

In the illustrated embodiment, the cavity 130 includes a shoulder 138 configured to block rotation of the housing 52 in a circumferential direction 140. In this manner, the cavity 130 blocks rotation of the housing in each circumferential direction 128 and 140, and blocks translation of the housing 52 in the downward direction 134. In alternative embodiments, the lower rim 136 may be elevated to the level of the shoulder 138 such that friction between the protrusion 124 and the lower rim 136 blocks rotation of the housing 52 in the direction 140. To remove the housing 52 from the frame 50, the operator may apply a force in the upward direction 126 against the spring bias. The upward force induces the protrusion 124 to translate in the upward direction 126 to a position non-adjacent to the shoulder 138. As a result, the housing 52 may be rotated in the circumferential direction 140 until the protrusion 124 aligns with the opening 122. The operator may then remove the housing 52 from the frame 50. Such a configuration may facilitate rapid insertion and removal of spray cans 16.

Figure 7:
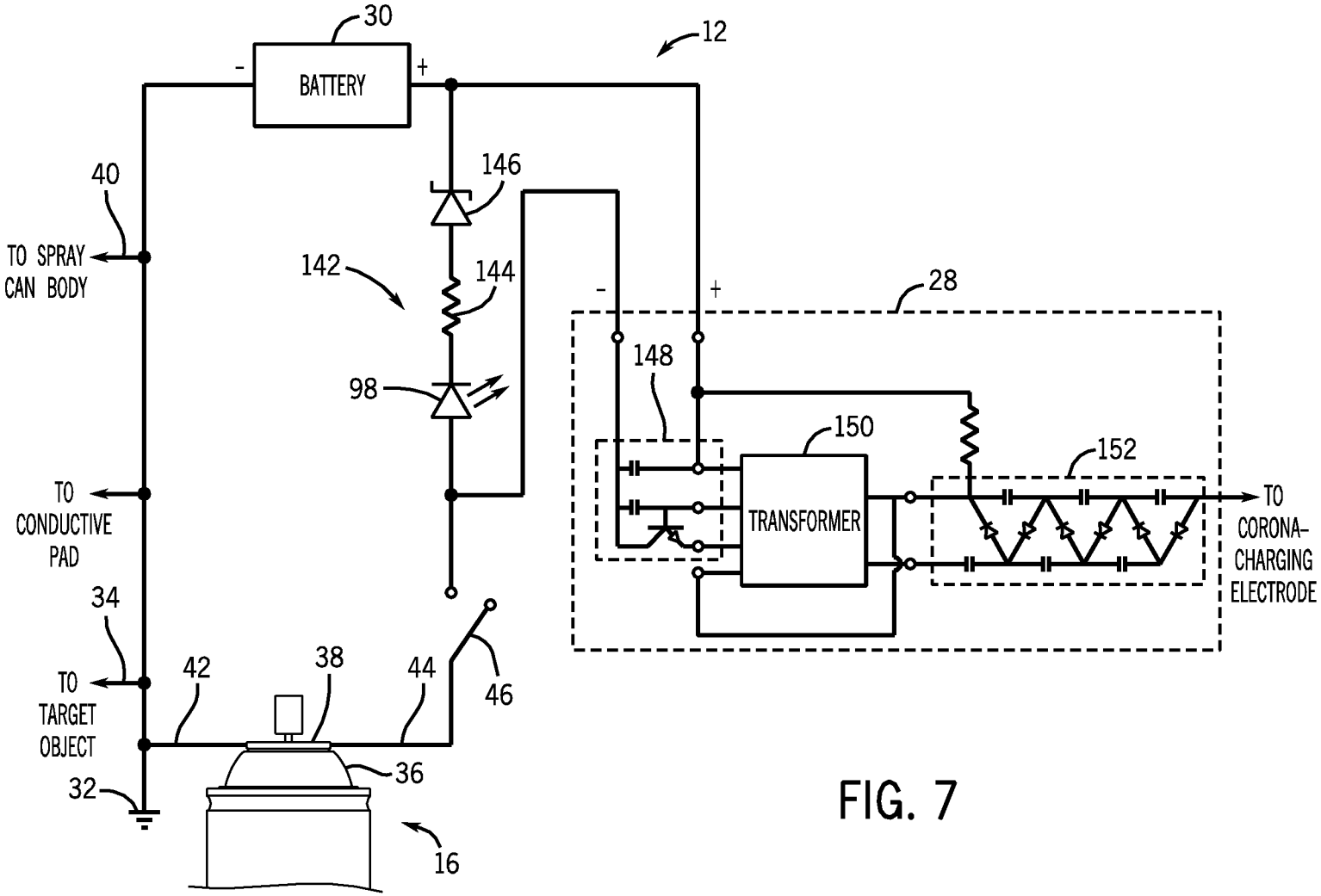
FIG. 7 is an exemplary circuit diagram of the spray device in accordance with certain embodiments of the present technique.

FIG. 7 is an exemplary circuit diagram of the spray device 12. As illustrated, an indicator circuit 142 is electrically coupled to the switch 46 and the positive terminal of the battery 30. The indicator circuit 42 is configured to both indicate operation of the electrostatic charging system and disable operation of the charging system if the battery voltage drops below a desired level. In the present embodiment, the indicator circuit 142 includes the LED 98, a resistor 144 and a Zener diode 146. In this configuration, the LED 98 will illuminate when the electrostatic charging system is in operation. Specifically, when the neck 38 of the self-contained spray can 16 is positioned between the conductors 42 and 44, and the switch 46 is in a closed position, an electrical path is established between the negative terminal of the battery 30 and a first side of the LED 98. A second side of the LED 98 is electrically connected to the positive terminal of the battery 30 via the resistor 144 and the Zener diode 146. As will be appreciated, the resistor 144 serves to reduce the voltage to the LED 98 to a suitable level for LED operation. As a result of this configuration, the LED 98 will illuminate during operation of the electrostatic charging system, thereby providing an indication to an operator that the spray of fluid 18 is being charged.

The Zener diode 146 serves to block current flow to the high-voltage power supply 28 and the LED 98 if the battery voltage drops below a desired level. As will be appreciated, diodes are configured to block current flow in one direction. However, Zener diodes facilitate current flow in the blocked direction if the supplied voltage is greater than a specified level. Consequently, in the present embodiment, the Zener diode 146 is configured to facilitate current flow to the LED 98 and high-voltage power supply 28 if the battery voltage is greater than an established value. For example, in certain embodiments, the battery 30 may be a commercially available 9V battery. In such a configuration, the high-voltage power supply 28 will be configured to increase the 9V input to a level suitable for electrostatically charging the spray of fluid 18 (e.g., 10.5 kV). Therefore, the Zener diode 146 may be configured to disable operation of the electrostatic charging system if the battery voltage drops below a level suitable for proper charging of the spray of fluid 18. For example, the Zener diode 146 may be configured to block current flow to the high-voltage power supply 28 and the LED 98 if the battery voltage drops below 8.5, 8, 7.5, 7, 6.5, 6 volts, or less. As will be appreciated, embodiments employing batteries having other voltages may utilize a Zener diode 146 having a different cut-off voltage. As a result of this configuration, illumination of the LED 98 indicates to the operator that the electrostatic charging system is activated and functioning within a desired voltage range.

As previously discussed, the high-voltage power supply 28 is configured to convert the voltage output by the battery 30 to a voltage suitable for operation of the corona-charging electrode 24. In the present embodiment, the high-voltage power supply 28 includes an inverter 148, a transformer 150 and a voltage multiplier 152. The inverter 148 is configured to convert the direct current (DC) from the battery 30 into an alternating current (AC) suitable for use by the transformer 150. In the present embodiment, the inverter 148 includes a transistor and capacitors to generate a simulated AC signal from the input DC signal. However, it should be appreciated that other inverter configurations may be employed in alternative embodiments. The AC signal then enters the transformer 150 where the voltage is multiplied. As will be appreciated, the voltage output by the transformer 150 may be approximately equal to the input voltage multiplied by the ratio of secondary windings to primary windings.

As illustrated, the transformer 150 is electrically coupled to the voltage multiplier 152 which also may be known as a Cockcroft-Walton generator. As will be appreciated, each stage of the voltage multiplier 152 includes two capacitors and two diodes. Consequently, the present embodiment employs a three-stage voltage multiplier 152. As will be further appreciated, the voltage output from the multiplier 152 is approximately equal to the input voltage times twice the number of stages. Therefore, the present voltage multiplier 152 is configured to output a voltage approximately equal to six times the input voltage. While a three-stage voltage multiplier 152 is utilized in the present embodiment, it should be appreciated that alternative multipliers may employ more or fewer stages. For example, certain voltage multipliers may include 1, 2, 3, 4, 5, 6, 7, 8, or more stages. By employing the voltage multiplier 152 to increase the voltage from the transformer 150, the overall size and weight of the high-voltage power supply 28 may be reduced compared to embodiments which only employ a transformer 150 to increase the voltage from the battery 30. While a Cockcroft-Walton voltage multiplier 152 is utilized in the present embodiment, it should be appreciated that alternative embodiments may employ other voltage multiplying circuits.

As previously discussed, the voltage output from the high-voltage power supply 28 may be approximately 10.5 kV in certain embodiments. Such a voltage may be suitable for use with the corona-charging electrode 24. Because the present embodiment employs the corona-charging electrode 24, the electrode 24 may be positioned outside of the flow path of the fluid spray 18, thereby substantially reducing or eliminating build-up of fluid on the electrode 24 and ensuring that the fluid droplets are sufficiently charged. Furthermore, because the spray can 16 is electrically coupled to the earth ground 32, a steep electrical gradient (e.g., large voltage over a small distance) may be maintained between the corona-charging electrode 24 and the spray can 16, thereby increasing the electrostatic charge on the fluid droplets and enhancing transfer efficiency between the fluid spray 18 and the target object 14. In addition, because the body 36 is grounded, a charge induced by the fluid droplets contacting the spray can 16 will be transferred to the earth ground 32, and dissipated. As a result, the potential of the spray can 16 may remain substantially equal to the potential of the earth ground 32, thereby substantially reducing or eliminating the possibility of establishing a voltage between the body 36 of the spray can 16 and an object at the ground potential.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a spray device, comprising:

a frame having a receptacle configured to receive a self-contained spray can;

a trigger assembly disposed within the frame and configured to selectively engage a spray of fluid from a spray nozzle of the self-contained spray can;

a first conductive element configured to contact the self-contained spray can;

a first electrical conductor extending between the first conductive element and an earth ground such that a first electrical potential of the self-contained spray can is substantially equal to a second electrical potential of the earth ground while the self-contained spray can is in contact with the first conductive element;

a conductive pad coupled to the frame and configured to contact an operator hand;

a second electrical conductor extending between the conductive pad and the earth ground; and a corona-charging electrode positioned adjacent to the spray nozzle of the self-contained spray can, wherein the corona-charging electrode is configured to emit a stream of ions toward the self-contained spray can such that the spray of fluid from the spray nozzle passes through the stream of ions and becomes electrostatically charged.

2. The system of claim 1, wherein the corona-charging electrode is positioned substantially outside of a flow path of the spray of fluid.

3. The system of claim 1, wherein the corona-charging electrode is coupled to the trigger assembly.

4. The system of claim 1, wherein the first conductive element is configured to contact a body of the self-contained spray can.

5. The system of claim 4, comprising:

a second conductive element configured to contact a neck of the self-contained spray can; and a third electrical conductor extending between the second conductive element and the earth ground.

6. The system of claim 5, wherein the first electrical conductor, the third electrical conductor, or a combination thereof, is electrically coupled to a target object.

7. The system of claim 5, comprising a third conductive element configured to contact the neck of the self-contained spray can, wherein electrical current to the corona-charging electrode is interrupted if the neck of the self-contained spray can does not contact the second conductive element and the third conductive element.

8. A system, comprising:

a spray device, comprising:

a frame having a receptacle configured to receive a self-contained spray can;

a trigger assembly disposed within the frame and configured to selectively engage a spray of fluid from a spray nozzle of the self-contained spray can;

a first conductive element configured to contact a body of the self-contained spray can;

a first electrical conductor extending between the first conductive element and an earth ground such that a first electrical potential of the body of the self-contained spray can is substantially equal to a second electrical potential of the earth ground while the body of the self-contained spray can is in contact with the first conductive element;

a second conductive element configured to contact a neck of the self-contained spray can;

a second electrical conductor extending between the second conductive element and the earth ground such that a third electrical potential of the neck of the self-contained spray can is substantially equal to the second electrical potential of the earth ground while the neck of the self-contained spray can is in contact with the second conductive element; and an indirect charging device configured to electrostatically charge the spray of fluid from the spray nozzle.

9. The system of claim 8, wherein the earth ground comprises an electrical connection to a building ground, to a water pipe, to a conductive stake disposed within soil, or a combination thereof

10. The system of claim 8, wherein the indirect charging device comprises a corona-charging electrode positioned adjacent to the spray nozzle of the self-contained spray can, and wherein the corona-charging electrode is configured to emit a stream of ions toward the self-contained spray can such that the spray of fluid from the spray nozzle passes through the stream of ions and becomes electrostatically charged.

11. The system of claim 8, wherein the spray device comprises a battery having a positive terminal electrically coupled to the indirect charging device via a high-voltage power supply, and a negative terminal electrically coupled to the earth ground.

12. The system of claim 8, comprising a third conductive element configured to contact the neck of the self-contained spray can, wherein electrical current to the indirect charging device is interrupted if the neck of the self-contained spray can does not contact the second conductive element and the third conductive element.

13. The system of claim 8, comprising:

a conductive pad coupled to the frame and configured to contact an operator hand; and a third electrical conductor extending between the conductive pad and the earth ground.

14. A system, comprising:

a spray device, comprising:

a frame having a receptacle configured to receive a self-contained spray can;

a trigger assembly disposed within the frame and configured to selectively engage a spray of fluid from a spray nozzle of the self-contained spray can;

an indirect charging device configured to electrostatically charge the spray of fluid from the spray nozzle;

a first conductive element configured to contact a neck of the self-contained spray can;

a second conductive element also configured to contact the neck of the self-contained spray can, wherein electrical current to the indirect charging device is interrupted if the neck of the self-contained spray can does not contact the first conductive element and the second conductive element; and a first electrical conductor extending between the first conductive element or the second conductive element, and an earth ground such that a first electrical potential of the neck of the self-contained spray can is substantially equal to a second electrical potential of the earth ground while the neck of the self-contained spray can is in contact with the first conductive element or the second conductive element.

15. The system of claim 14, wherein the indirect charging device comprises a corona-charging electrode positioned adjacent to the spray nozzle of the self-contained spray can and substantially outside of a flow path of the spray of fluid, and wherein the corona-charging electrode is configured to emit a stream of ions toward the self-contained spray can such that the spray of fluid from the spray nozzle passes through the stream of ions and becomes electrostatically charged.

16. The system of claim 14, wherein the first electrical conductor is electrically coupled to a target object.

17. The system of claim 14, comprising:

a third conductive element configured to contact a body of the self-contained spray can; and a second electrical conductor extending between the third conductive element and the earth ground such that a third electrical potential of the body of the self-contained spray can is substantially equal to the second electrical potential of the earth ground while the body of the self-contained spray can is in contact with the third conductive element.

18. The system of claim 14, wherein the spray device comprises an electrical switch configured to selectively activate the indirect charging device, and wherein the switch is positioned such that the trigger assembly closes the switch while the trigger assembly is positioned to engage the spray of fluid from the spray nozzle.

19. The system of claim 14, wherein the spray device comprises a removable housing having an open portion configured to interface with the receptacle of the frame, and wherein the removable housing is configured to enclose the self-contained spray can and bias the self-contained spray can toward the receptacle while the removable housing is coupled to the frame.

* * * * *